US005090348A

United States Patent [19]

Hugron

[11] Patent Number: 5,090,348

[45] Date of Patent: Feb. 25, 1992

[54] TRAFFIC SIGNALLING POST

[76] Inventor: Denis P. Hugron, 1855, Georges, St.-Hubert, Quebec, Canada, J4T 1W2

[21] Appl. No.: 675,430

[22] Filed: Mar. 26, 1991

[51] Int. Cl.[5] ..... E01F 9/01

[52] U.S. Cl. ..... 116/63 R; 40/608; 248/530; 404/10

[58] Field of Search ..... 40/598, 608, 610, 612; 52/103, 153, 165; 116/63 R, 173, 209; 248/529, 530, 532, 545; 404/10, 11; 277/212 C, 212 F, 212 FB, 237 A

[56] References Cited

U.S. PATENT DOCUMENTS

| | | | |
|---|---|---|---|
| 3,225,734 | 12/1965 | Bule | 116/63 R |
| 4,343,567 | 8/1982 | Sarver et al. | 404/10 |
| 4,486,117 | 12/1984 | Blau | 404/10 |
| 4,977,851 | 12/1990 | Anderson | 116/209 |
| 5,029,783 | 7/1991 | Alvarez | 248/146 |

FOREIGN PATENT DOCUMENTS

| | | | |
|---|---|---|---|
| 0626097 | 10/1961 | Italy | 404/10 |
| 0940775 | 11/1963 | United Kingdom | 404/10 |

*Primary Examiner*—William A. Cuchlinski, Jr.
*Assistant Examiner*—W. Morris Worth
*Attorney, Agent, or Firm*—Roland L. Morneau

[57] ABSTRACT

The invention is a traffic signalling post which comprises a flexible rod member, a rigid shaft coaxially secured at one end to the rod member, an anchor bore member adapted to house the shaft for maintaining the latter in a vertical position. The bore member has a perforated elastic diaphragm for peripherally sealing the shaft at a location adjacent the rod member when the latter sits in the bore member. The diaphragm is particularly characterized by a pair of rectilinear lips extending upwardly and adapted to be depressed downwardly with the introduction of the shaft in the anchor bore member and to be raised upwardly by the retraction of the shaft from the anchor bore member.

5 Claims, 3 Drawing Sheets

TRAFFIC SIGNALLING POST

BACKGROUND OF THE INVENTION

1. Field of the Invention

The present invention relates to signalling posts for signalling a pathway for cars, buses or bicycles and to such posts adapted to be unintentionally hit without causing substantial damages to the vehicles or bodily harm to the drivers, passengers or persons around the posts or inside the vehicles.

2. Prior Art

A search made by the inventor has failed to reveal pertinent references.

Two types of signalling posts are extensively used. The first consists of a solid heavy base such as concrete on which is secured a rigid tubular member. This concrete base is not anchored to the ground but can cause bodily and material damage when hit. The second type of post consists of light plastic or rubber cones removably disposed to delimit a temporary pathway. These cones are so light as to topple when slightly touched by passing vehicles. They are also disturbed by passersby, are used as toys by children and are easily stolen.

SUMMARY OF THE INVENTION

Accordingly, the present invention relates to a signalling post which while being solidly anchored to the ground can resiliently deform upon impact in order to prevent damages both to the post and to the structure which initiated the impact.

The present invention also relates to a structure which can be easily installed and retracted from the ground. The proposed structure once retracted from the ground can easily be manipulated and stored for ulterior usage.

Furthermore, the proposed type of anchoring means does not protrude from the ground and thus will not cause obstruction when the post is temporarily removed from it.

The present invention thus relates to a traffic signalling post which comprises a flexible base member and a hollow rod member fixed to the base member. The base member comprises a tubular coil spring which has a bulging girth portion between both of its ends. A tension means is internally mounted inside the spring and fixed at both of its ends. The internally mounted tension means keep traction between both ends of the coil spring and flexibly maintains the coil spring in the vertical position. The tension means is also adapted to return the coil spring in its original vertical position and dampen its recoil after deformation. Means are provided at one of the ends of the coil spring for releasably securing it to an anchor base. Means are provided at the other end of the coil spring for gripping the rod member so that the rod member extends upwardly and coaxially from the coil spring. The rod member is adapted to flex the flexible base upon lateral traction on the rod member.

In a specific embodiment of the invention, the securing means comprises a threaded stem and a peripherally sitting surface adapted to abut against the anchor base when the stem is threadily engaged in the anchor base.

The rod member has an internal contour to fittingly grip a corresponding contour of the top end of the coil spring. The tension means is ideally a cylindrical coil spring secured at both ends to the respective ends of the tubular coil spring both of the springs being made of spring steel.

In another embodiment of the invention, the traffic signalling post comprises a flexible rod member and a rigid shaft coaxially secured at one end of the rod member. An anchor bore member is adapted to house the rod member for maintaining the latter in a vertical position. The bore member has a perforated elastic diaghram for peripherally sealing the shaft at the location adjacent the rod member when the latter sits on the bore member. The rod member is characterized by a flexibility allowing it to bend upon a lateral blow on a portion intermediate to both of its ends.

DETAILED DESCRIPTION OF THE PREFERRED EMBODIMENT

Figures 1, 2, 3:
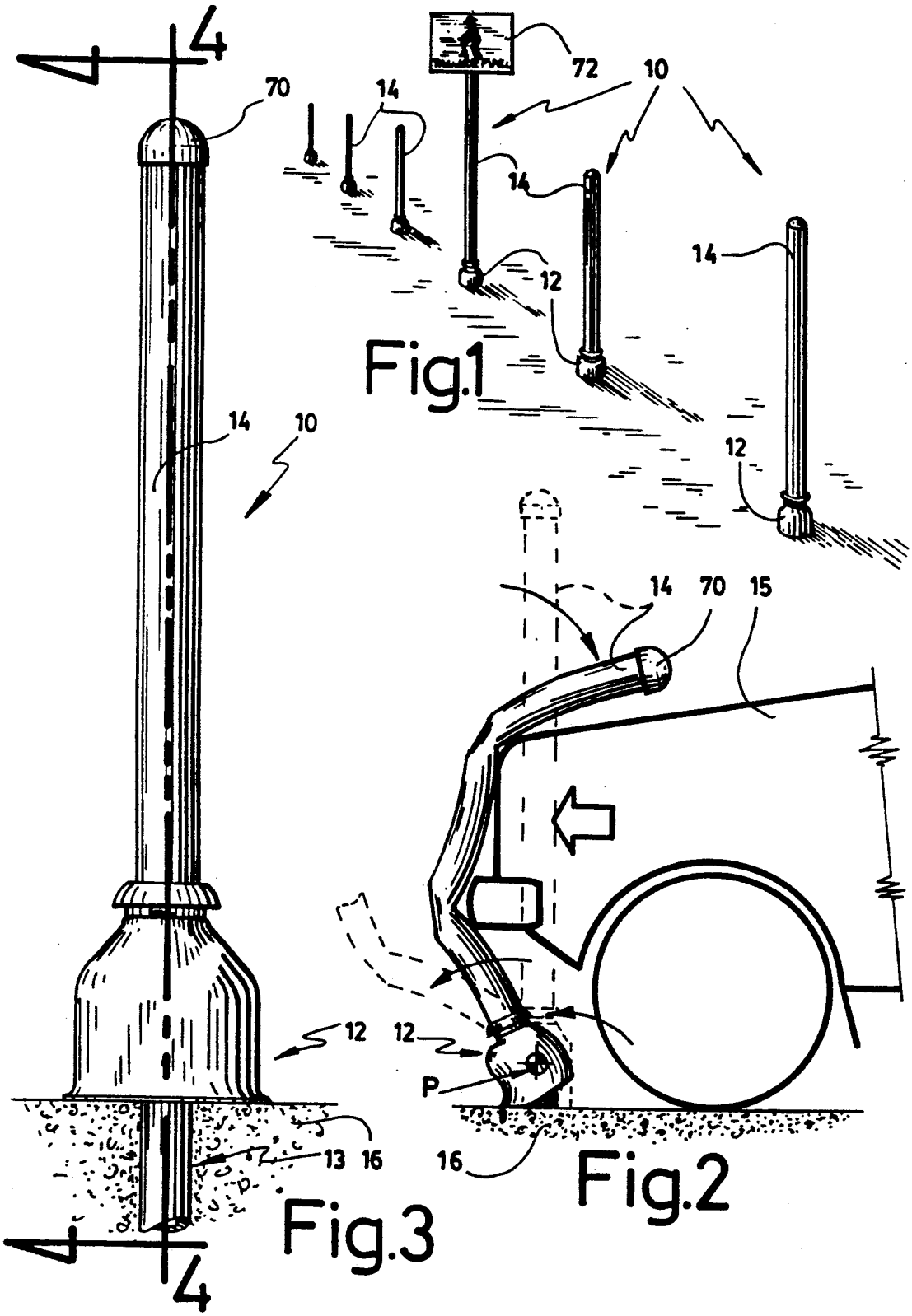
FIG. 1 is a perspective view of a row of traffic signalling posts embodying the invention.
FIG. 2 is an elevational view of the front end of a car hitting a signalling post, the signalling post being temporarily deformed upon impact.
FIG. 3 is an elevational view of the traffic signalling post.

FIG. 1 illustrates a row of signalling posts 10 embodying the invention. Each signalling post 10 has a base member 12 and a hollow rod member 14 fixed to the base member 12. The base member 12 is releasably connected to an anchor base 13 which is anchored into the ground 16.

The hollow rod member 14 is preferably made out of a cylindrical extrusion of polymeric materials such as polyethylene adapted to resiliently deform upon impact.

FIG. 2 illustrates an example of a resilient deformation of the hollow rod member 14 resulting from the frontal collision of a vehicle 15 on the signalling post 10. Since the rod member 14 resiliently deforms upon impact, damages to both the signalling post and the body initiating the impact are kept to a minimum level.

Figure 4A:
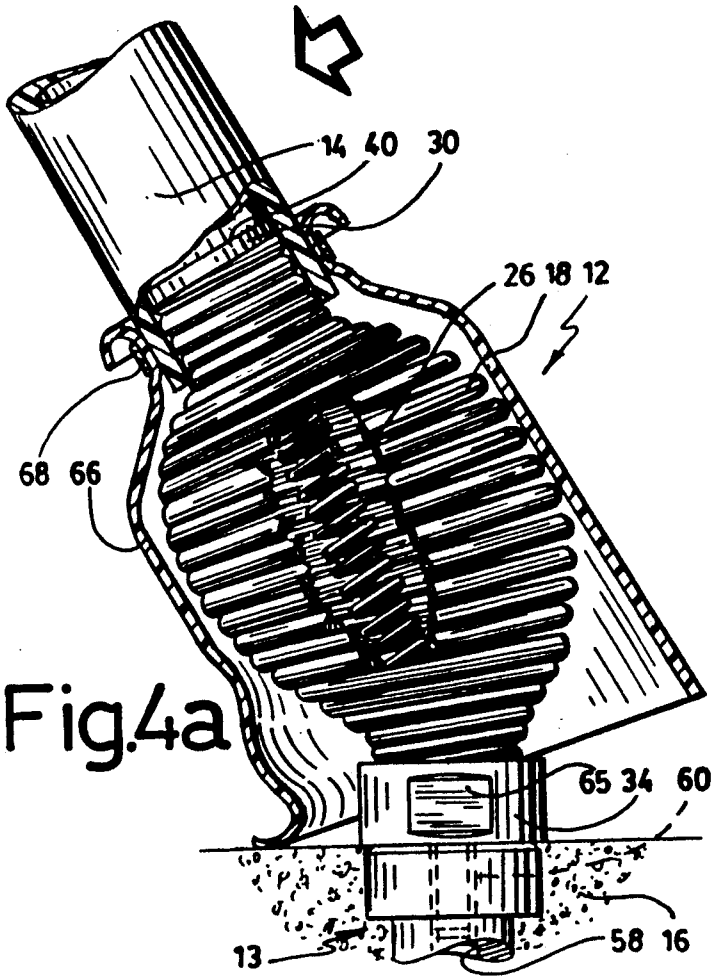
FIG. 4*a* is a cross-sectional view of the first embodiment of the base member illustrated in FIG. 4 being temporarly deformed upon impact on the hollow rod member above it.
Figure 4:
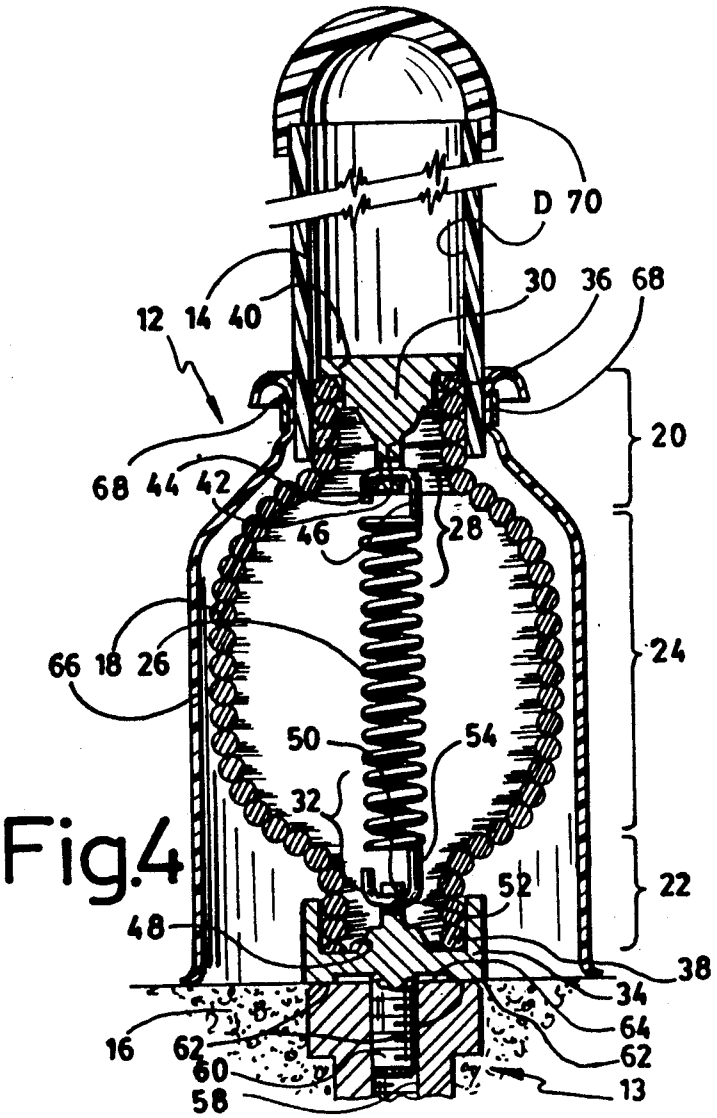
FIG. 4 is a cross-sectional view of a first embodiment of the base member of the post taken along 4—4 of FIG. 3.
Figure 5:
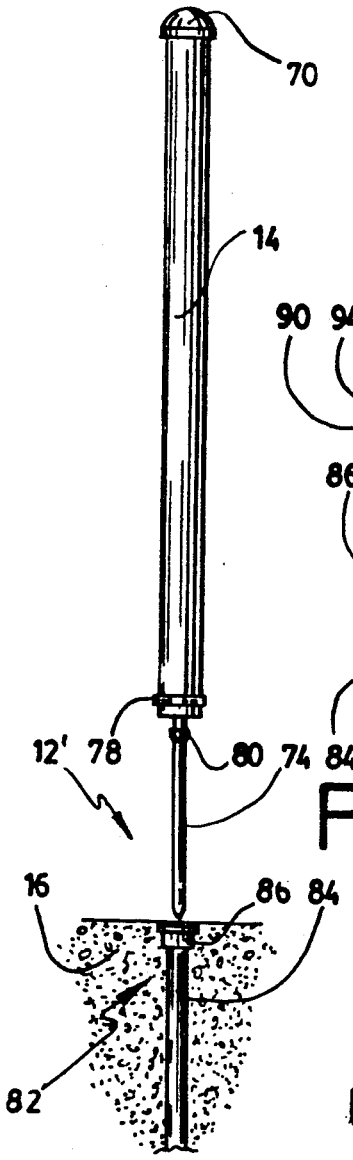
FIG. 5 is an elevational view of a second embodiment of the invention.

Referring more specifically to FIGS. 4 and 4*a*, there is shown a first embodiment of the invention specifically adapted to further enhance the property of the signalling post 10 to resiliently deform upon impact. In this first embodiment of the invention the base member 12 comprises an external tubular coil spring 18 having a top neck portion 20, a bottom neck portion 22 and a bulging girth portion 24 located between the neck portions 20 and 22.

An internal cylindrical coil spring 26 is internally mounted inside the external coil spring 18. The internal coil spring 26 is attached at its upper end portion 28 to a top retaining cap 30 and at its lower end portion 32 to a bottom retaining cap 34.

Since the top retaining cap 30 and the bottom retaining cap 34 abut respectively against the uppermost spire 36 and the lowermost spire 38 of the external coil spring 18, the internal coil spring 26 exerts a resilient traction adapted to keep the external coil spring 18 under a resilient longitudinal compression.

As illustrated in FIGS. 2 and 4*a*, the base member 12 will flex laterally from the vertical plane upon impact on the rod member 14 to which it is attached. This particular structure of the base member 12 will thus further enhances the ability of the signalling post 10 to resiliently deform upon impact.

The internal coil spring 26 is adapted to return the external coil spring 18 to its vertical position and to dampen its recoil after the impact. The dampening effect of the internal coil spring 26 prvents the rod member 14 from oscilating in a vertical plane about its base thus further limiting possible damages after impact to the body which created the impact.

The top retaining cap 30 has an upper flange 40 adapted to abut against the upper most spire 36 of the external coil spring 18 and a downwardly extending prong 42 provided with an aperture 44 into which the top hooking portion 46 of coil spring 26 is inserted. The bottom retaining cap 34 has a lower flange portion 48 adapted to abut against the lower most spire 38 of the external coil spring 18. The bottom retaining cap 34 also has an upwardly extending prong 50 provided with an aperture 52 adapted to receive a bottom hooking portion 54 of the internal coil 26.

The anchor base 13 is provided with a longitudinal internally threaded channel 58. A threaded stem 60 formed integral with the bottom retaining cap 34 is adapted to be threadedly engaged inside channel 58. A peripherally sitting surface 62 also formed integral with the retaining cap 34 is adapted to abut evenly against the top surface 64 of the anchor base 13.

The signalling post 10 can thus be readily installed or removed from its anchor base 13 by a screwing action. A pair of diametrically opposed flats 65 adapted to facilitate the gripping of the cap during installation of the post 10 is provided on the outer periphery of the bottom retaining cap 34. Furthermore, since the anchor base 13 is positioned slightly below the top surface of the ground 16, once the post is removed from its anchor base 13 there are no protrubing structure above the ground 16 which would cause obstruction.

The hollow rod member 14 has an internal diameter referred to in FIG. 4 by arrows D, adapted to fittingly grip the upper neck portion 20 of the internal coil spring 18.

A flexible protective skirt 66 preferably made out of elastomeric material encloses the base member 12. The protective skirt 66 which is secured to the upper portion 20 of the external coil spring 18 by a retaining ring 68 is adapted to protect the base member 20 from environmental elements such as rain, mud, snow or the like. The ring 68 also serves the purpose of securing the rod member 14 to the coil spring 18.

A sealing cap 70 is fittingly positioned on top of the hollow rod member 14. Optionally, a signalling plate such as the one referred to by numeral 72 in FIG. 1 can be secured to the top portion of the hollow rod member 14 instead of the sealing cap 70.

In the preferred version of the first embodiment, the external coil spring 18 has spires 3/16 of an inch to 5/16 of an inch in diameter and a height of 7 to 12 inches. The diameter of both neck portions 20 and 22 varies from 1" to 2½ inches and the diameter of the bulging girth portion 24 varies from 3 to 5 inches. The internal cylindrical coil spring 26 has a height of about 3 to 4 inches and a diameter of about 1 to 1½ inches. The diameter of each spire of the internal coil spring 26 being about ⅛th of an inch to 3/16th of an inch.

The hollow rod member 14 is preferably made of a heavy plastic material such as polyethylene.

In a second embodiment of the invention, the flexible base member 12 is replaced by a rigid base member 12' illustrated more specifically in FIGS. 5 to 8. The base member 12' has a rigid shaft 74 fittingly linked to a cylindrical connecting element 76.

The cylindrical connecting element 76 is adapted to be fittingly inserted inside the hollow rod member 14. A tightening ring 78 positioned around the outer periphery of the rod member 14 is adapted to squeeze the hollow rod member 14 in order to releasably retain the connecting element 76 inside the hollow rod member 14.

A locking collar 80 is secured to the rigid shaft 74 adjacent the cylindrical connecting element 76.

An anchor bore member 82 adapted to house and maintain in a vertical position the rod member 74 is anchored in the ground 16. The anchor bore member 82 comprises a tubular sleeve portion 84 surmounted by a connecting component 86. The connecting component 86 is attached to the sleeve portion 84 by welding ring 88. The connecting components extend integrally at its upper portion into a flange 90. The flange 90 peripherally supports a perforated elastic diaghram 92. An annular rim 94 attached to the flange 90 by a set of screws 96 squeezes the outer periphery of the diaghram 92 securing it to the connecting component 86.

The diaghram 92 is preferably made of elastomeric material and has a rectilinear slot 98 surrounded by a pair of upwardly protrubing lips 100. The perforated diaghram 92 is adapted to seal off the anchor bore member 82 from water, rain, mud and the like when the rod member 74 is not inserted therein. The lip 100 releasably grips the rod member 74 when the latter is inserted into the anchor bore member 82 as illustrated in FIG. 6*a*.

Figure 6:
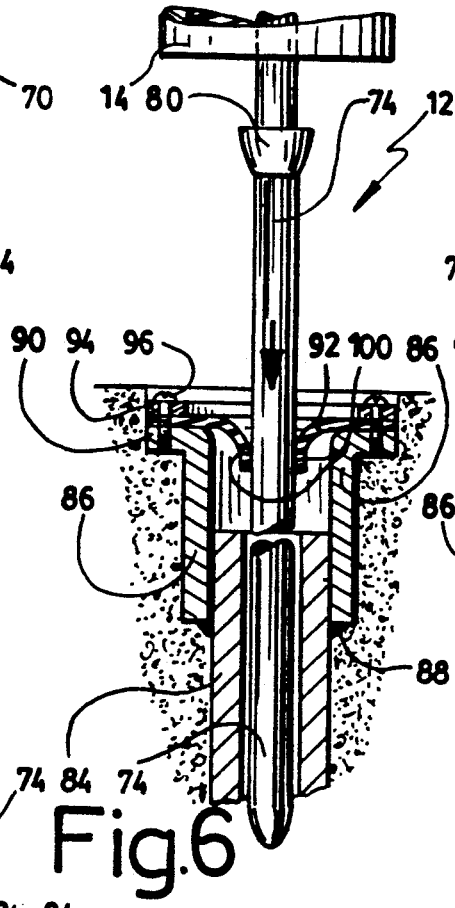
FIG. 6 is a detailed cross-sectional view of the base portion of a second embodiment being inserted in the anchoring means.
Figure 6A:
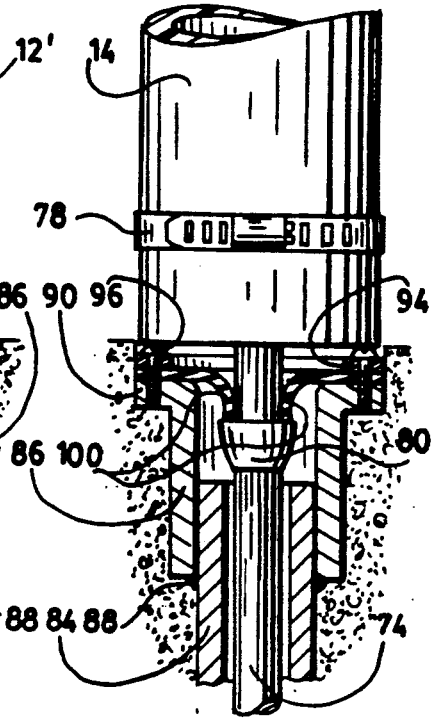
FIG. 6*a* is a view of the base portion of the second embodiment once inserted in the anchoring means.

As illustrated in FIG. 6, during installation of the post 14 into its anchor bore member 82, the rod member 74 is inserted in the slot 98 (FIG. 7), pushing the edges of the lips 100 downwardly. The rod member 74 is pushed down until the edges of the lips 100 come into contact with the upper portion of the locking collar 80 thus releasably and sealingly locking the rod members 74 inside the anchor bore member 82.

Figure 6B:
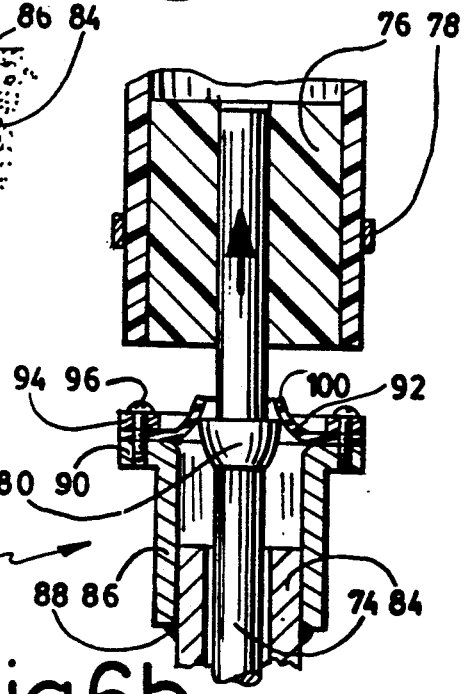
FIG. 6*b* is a detailed cross-sectional view of the base portion of the second embodiment being retracted from the anchoring means.
Figure 7:
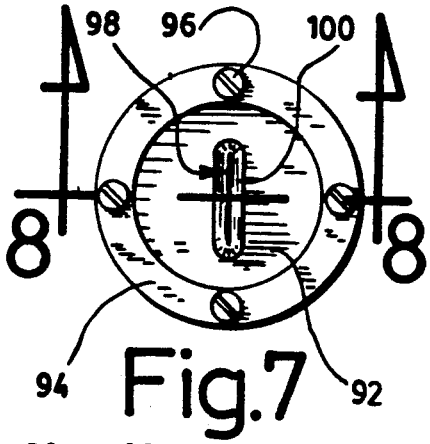
FIG. 7 is a top view of the anchoring means of the second embodiment.
Figure 8:
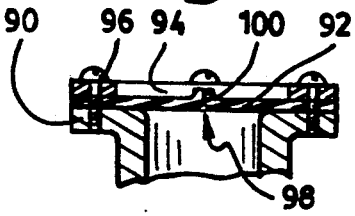
FIG. 8 is a cross-sectional view taken along line 8—8 of FIG. 7.

Since the diaghram 92 is made of an elastomeric material, the rod member 74 can be retracted from the anchor bore member 92 by a strong pulling action. FIG. 6*b* illustrates the configuration of the lips 100 during the retraction of the rod member 74 from the anchor bore member 82.

This second embodiment of the invention thus also provides a signalling post which is adapted resilient deformation upon impact, while being firmly anchored to the ground. As was the case with the first embodiment, the structure also allows for easy installation and removal from the ground. Furthermore, the anchoring means do not represent an obstructing structure once the post is retracted from it.

I claim:

1. A traffic signalling post comprising a flexible rod member, a rigid shaft coaxially secured at one end of said rod member, a locking collar peripherally secured to said shaft at a location adjacent and spaced from said rod member, an anchor bore member releasably housing said shaft for maintaining said shaft in a vertical position, said bore member extending upwardly into a peripheral flange, a perforated elastic diaphragm peripherally secured on said flange for sealing said shaft at a location between said locking collar and said rod member, when the latter sits in the bore member, said diaphragm being provided with a perforation having upper extending lips sealingly surrounding said perforation, said lips being adapted to be depressed downwardly with the introduction of the shaft in the anchor bore member and to be raised upwardly by the retraction of the shaft from said anchor bore member, said rod member being characterized by a flexibility allowing it to bend upon a lateral blow on a position intermediate both ends thereof.

2. A traffic signalling post as recited in claim 1, wherein the rod member is a hollow tube made of polyethylene material.

3. A traffic signalling post as recited in claim 1, wherein the locking collar has an upper portion peripherally surrounding said shaft, said upper portion adapted to abut against said lips for sealingly locking the rod member inside the anchor bore member.

4. A traffic signalling post as recited in claim 3, wherein said perforation and said lips are rectilinear when said shaft is removed from said diaphragm, said lips abuting on each other for sealingly closing said perforation.

5. A traffic signalling post as recited in claim 4, wherein said anchor bore member is a hollow tubular member having an inner diameter slightly larger than the diameter of said shaft, for maintaining said shaft in a substantially vertical position.

* * * * *